US006435154B1

(12) United States Patent
Simpson et al.

(10) Patent No.: US 6,435,154 B1
(45) Date of Patent: Aug. 20, 2002

(54) VCT CONTROLS INTEGRATED INTO FRONT COVER OF ENGINE

(75) Inventors: Roger T. Simpson, Ithaca; Danny R. Taylor, Freeville, both of NY (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/886,736

(22) Filed: Jun. 21, 2001

(51) Int. Cl.[7] ..... F02F 7/00

(52) U.S. Cl. ..... 123/195 C; 123/90.15; 123/90.17; 123/90.38; 123/198 E

(58) Field of Search ..... 123/198 E, 90.38, 123/195 C

(56) References Cited

U.S. PATENT DOCUMENTS

| | | | | |
|---|---|---|---|---|
| 4,653,458 A | * | 3/1987 | Bergsten | 123/612 |
| 4,895,113 A | | 1/1990 | Speider et al | 123/90.17 |
| 5,218,935 A | | 6/1993 | Quinn, Jr. et al. | 123/90.17 |
| 5,353,755 A | | 10/1994 | Matsuo et al. | 123/90.13 |
| 5,497,738 A | | 3/1996 | Siemon et al. | 123/90.17 |
| 6,050,236 A | * | 4/2000 | Sawaki et al. | 123/195 C |
| 6,178,939 B1 | * | 1/2001 | Powell | 123/184.23 |
| 6,247,436 B1 | | 6/2001 | Lancefield et al. | 123/90.38 |
| 6,293,244 B1 | * | 9/2001 | Mullins et al. | 123/190 R |
| 6,343,580 B2 | * | 2/2002 | Uchida | 123/90.17 |

FOREIGN PATENT DOCUMENTS

JP 09068053 A 3/1997

* cited by examiner

*Primary Examiner*—Thomas Denion
*Assistant Examiner*—Ching Chang
(74) *Attorney, Agent, or Firm*—Brown & Michaels, PC

(57) ABSTRACT

A front cover for an internal combustion engine comprises variable cam timing (VCT) controls integrated into the cover, including a variable force solenoid (VFS) and a cam position sensor located in front of and operably connected to a cam phaser. In an embodiment of the invention, the engine cover, once assembled, comprises a single unit having an electronic interface module (EIM), VFS and position sensor integrated within said cover.

13 Claims, 1 Drawing Sheet

VCT CONTROLS INTEGRATED INTO FRONT COVER OF ENGINE

BACKGROUND OF THE INVENTION

1. Field of the Invention

The invention pertains to the field of internal combustion engines. More particularly, the invention pertains to the integration of variable cam timing controls into the engine's front cover.

2. Description of Related Art

Internal combustion engines have become increasingly complex, as features such as variable cam timing (VCT) and active noise cancellation are included. For example, using VCT, the angular displacement, or phase of a camshaft, relative to the crankshaft to which it is drivably connected, is dynamically altered to bring about changes in engine characteristics, such as fuel economy or power. Typically, there is a feedback loop in which the desired values of such engine characteristics are measured against their existing values, and changes are effected inside the engine in response to discrepancies. To accomplish this, modern automobiles usually have a control module (or more than one) having a microcomputer that constantly analyzes data fed into it from various parts of the engine and other parts of the automobile and ambient conditions (exhaust gas sensors, pressure and temperature sensors, etc.) and emits signals in response to such data. For example, in regard to VCT, as changes occur in engine and external conditions, the angular displacement between the cam shaft and the crank shaft that drives it is altered.

The conventional method of connecting a system, such as a VCT system, to the control module is to run a set of wires from each solenoid, valve, actuator or motor and each sensor back to the engine controller. As a result, the number of wires feeding into the engine controller has recently become unmanageable. For example, some engine controllers now have upwards of 150 to 200 externally-connected wires. With such increased complexity of engines, it is becoming more difficult for the engine controller to manage all of the features, due to their fast update rate and fast computational speed requirements.

Various attempts have been made to address the problem of managing such increased engine complexity. For example, U.S. Pat. No. 5,353,755 to Matsuo et al. discloses a variable valve timing control system incorporated into the front cover of a V-type internal combustion engine. The patent teaches a V-type engine comprising a plurality of hydraulically actuated valve operation mode control actuators for two cylinder banks. A hydraulic fluid network is fluidly disposed between a main gallery of the cylinder block and the plurality of hydraulically actuable valve operation mode control actuators, and includes a single control valve, which is common to all of the hydraulically actuable valve operation mode control actuators. This control valve is attached to a casing adapted to receive a drive system connecting the engine camshafts to the engine crankshaft. The casing also has internal passages forming a part of the hydraulic fluid network between the control valve and the plurality of hydraulically actuable valve operation mode control actuators. However, the prior art does not teach incorporation of VCT sensors or the VCT control unit into the front engine cover.

It will be understood by one skilled in the art that in the context of this invention the term "front cover" refers to the cover over the timing components of the engine—the camshaft drive element(s) (gear, sprocket or pulley) and cam phaser(s), the crankshaft end and drive element (gear, sprocket or pulley), and the power transmission component (chain, belt or gears) connecting the crankshaft drive to the cam drive(s). In the traditional fore-and-aft engine mounting, this cover would usually be toward the front of the engine (hence the term, "front cover"), but it will be understood that in other engine mounting schemes it might be toward the side of the car (as in a transverse engine) or facing the rear.

SUMMARY OF THE INVENTION

A front cover for an internal combustion engine comprises variable cam timing (VCT) controls integrated into the cover, including variable force solenoids (VFS) and cam (and possibly crankshaft) position sensors, the cover being located in front of and operably connected to a cam phaser. A VCT control module, also mounted on the cover, communicates with the actuators and sensors, and provides the connection to the car's control module, thus limiting the number of external conductors necessary to interface with the VCT system. In one embodiment of the invention, the engine cover, once assembled, comprises a single unit having an electronic interface module (EIM), VFS and position sensor integrated within said cover. This invention allows the cam position sensor to sense the cam position from a wheel mounted in front of the cam phaser, rather than from a pulse wheel mounted on the cam.

DETAILED DESCRIPTION OF THE INVENTION

As engines increase in complexity from control systems having phasers mounted on the intake cam to control systems having phasers mounted on both the intake and exhaust cam (and, in "V" type engines, phasers on two intake and two exhaust cams), it is more difficult to mange the control system. The typical cam phaser system includes a position sensor wheel on the cam, which sends a signal back to the engine controller. However, the inventors of the present invention have found that by moving both the control solenoid and the cam position sensor for each cam to the front of the cam phaser, the solenoid and cam position sensors can be mounted in the front cover. This invention allows the cam position sensor to sense the cam position from a wheel mounted in front of the cam phaser, rather than from a pulse wheel mounted on the cam.

Figure 2:
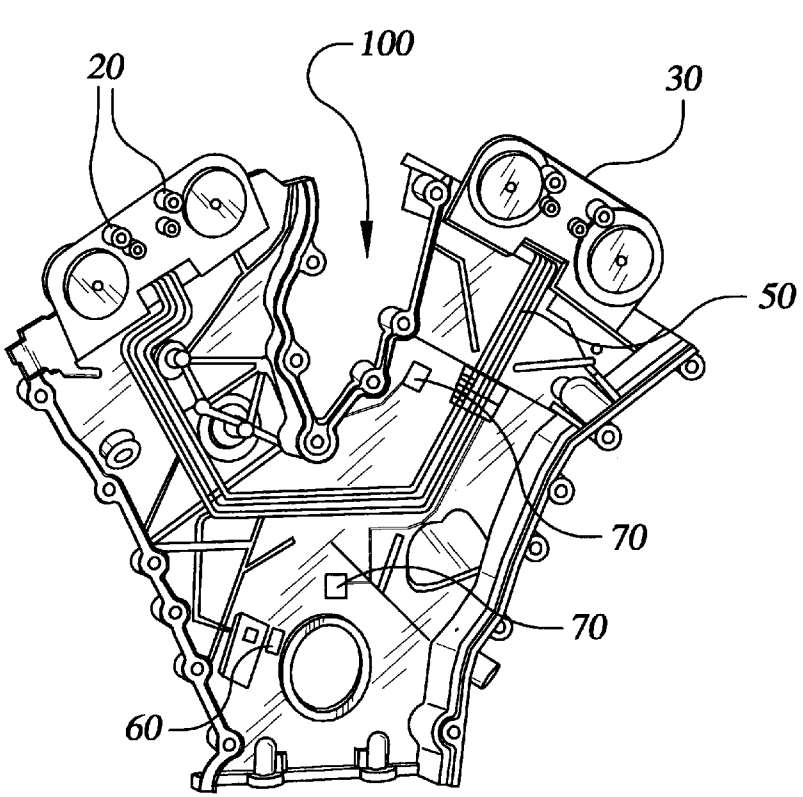
FIG. 2 shows a schematic view of the rear or internal side of an engine front cover having integrated VCT controls, according to an embodiment of the present invention.
Figure 1:
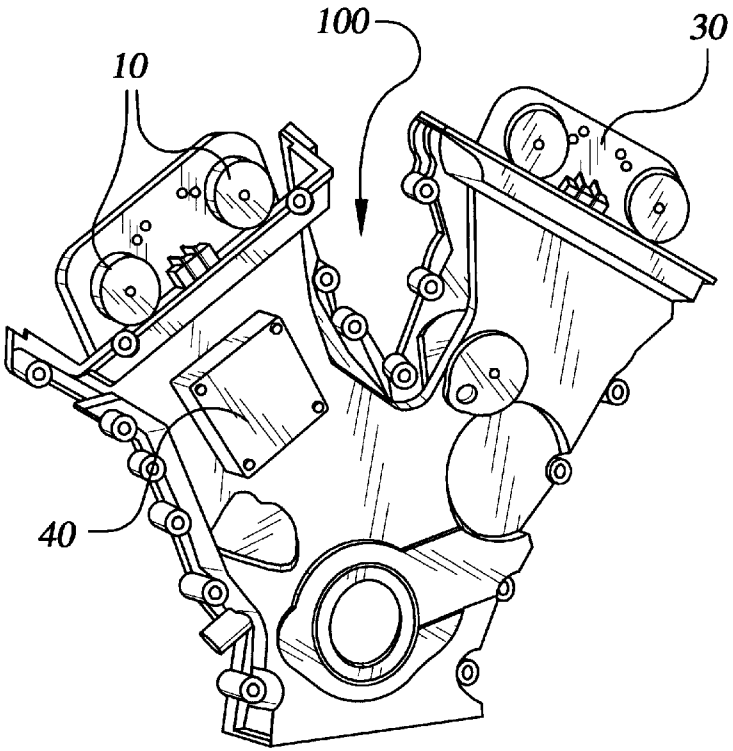
FIG. 1 shows a schematic view of the front side of an engine front cover having integrated VCT controls, according to an embodiment of the present invention.

Referring to FIGS. 1–2, the EIM 40 is mounted to the front cover 100. A controller area network (CAN) bus input to the electronic interface module (EIM) 40 also preferably is included, which allows the control system of the present invention to receive set point commands from the engine control module (ECM). The CAN bus input can be in any form convenient to the engine design, for example a one or more pairs of wires, fiber optics, etc.

The VCT control system of the present invention preferably includes a crank position sensor 60 mounted to the engine front cover 100. The crank position sensor could be mounted on the front of the engine, instead, or the crank position sensed in some other way, but that would necessitate additional conductors to convey the crank position information to the EIM.

Each cam location on an engine has a cam bank 30 with connections for receiving a phaser actuator 10 (in FIGS. 1–2, a variable force solenoid (VFS)) and a cam position sensor 20 for each cam at the location. In the "V" type dual overhead cam embodiment of FIGS. 1–2, there are four VFS 10 and four cam sensors 20 in two banks 30. It will be understood by one skilled in the art that the cover of the invention can be applied to other types of engines as well: a single cam four-cylinder engine would have only one cam bank with one actuator and one sensor, a single camshaft "V" or horizontally opposed type engine would have two banks, each with one actuator and one sensor, and a dual cam inline-type engine would have one bank with two actuators and two sensors.

The EIM 40 is preferably mounted into a recess and plugs into an interconnect harness 50 that connects the each cam bank to the EIM. The interconnect harness 50 is mounted inside the cover, so that the terminals do not have to be exposed to the elements inside the engine compartment. The harness is molded to follow the contour of the inside of the cover.

Once assembled, the front cover 100 comprises a single unit with the EIM 40, VFS 10 and cam position sensors 20 being integrated into the unit. Other features optionally are added to the front cover, such as, for example, active noise reduction 70.

The control system of the present invention reduces the overall cost of the variable cam timing system, by eliminating more than twenty wires to the engine controller. Thus, the only connections to the engine compartment that are required are power (supply voltage and ground), the CAN bus, and optionally a buffered crank signal for the engine controller. The overall engine control system is simplified by the use of the invention, as the ECM needs only to calculate a desired cam timing and supply a VCT set point signal to the assembly of the invention, rather than having to read cam and crank sensor signals, compute present cam positions and desired cam offsets and drive each VFS separately. Moving the cam timing control to the valve cover also simplifies design and production by allowing the ECM designer to ignore variations and production changes in cam sensors and actuators, as the EIM handles the actual interfacing with the VCT components.

It is estimated that the cost for each wire and connector can be as much as $1 per wire. Thus, the cost of assembly at the engine plant is reduced, because the front cover module, which contains all the actuators and sensors, can be assembled as a unit, rather then individually as separate parts. Overall reliability is increased, as each wire eliminated also eliminates a potential source of corrosion, noise, trouble and expense for the car owner and the dealer.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A front cover for an internal combustion engine having a crankshaft with a crankshaft drive element connected to an end of the crankshaft, at least one camshaft with a camshaft drive element and a variable cam phaser connected to an end of the camshaft, the cam phaser permitting an angular offset between the camshaft and the camshaft drive element, and a power transmission component connecting the crankshaft drive element to the at least one camshaft drive element, comprising:

a cover adapted to enclose the camshaft drive element, the power transmission component, the at least one camshaft drive element and variable cam phaser;

for each variable cam phaser, a cam phaser position sensor mounted on the cover in a location such that when the cover is mounted on the engine the cam phaser position sensor is adjacent to the variable cam phaser;

for each variable cam phaser, a cam phaser actuator mounted on the cover in a location such that when the cover is mounted on the engine the cam phaser actuator can operate the variable cam phaser; and a variable cam timing control, mounted on the cover, operatively coupled to the cam phaser position sensor and the cam phaser actuator.

2. The engine cover of claim 1, wherein the cam phaser actuator is a variable force solenoid.

3. The engine cover of claim 1, wherein the engine is a "V" type engine, and there are two cam banks, each bank comprising at least one cam phaser position sensor and at least one cam phaser actuator.

4. The engine cover of claim 3, in which the engine is a dual overhead cam engine, and each cam bank comprises two cam phaser position sensors and two cam phaser actuators.

5. The engine cover of claim 1, wherein the variable cam timing control comprises an electronic interface module having a control input for connection to an engine controller, at least one sensor input coupled to the cam phaser position sensor and at least one actuator output coupled to the cam phaser actuator.

6. The cover of claim 5, in which the connection between the variable timing control and the engine controller is a controller area network bus.

7. The cover of claim 5, in which the control input receives a set point command from the engine controller, and adjusts a phase of the camshaft in accordance with the set point signal by reading the cam phaser position from the sensor input and supplying an actuating signal to the variable cam phaser output.

8. The cover of claim 5, further comprising a crankshaft position sensor, coupled to the electronic interface module, mounted on the cover in a location such that when the cover is mounted up on the engine, the crankshaft position sensor is adjacent to the crankshaft drive element.

9. The engine cover of claim 8, in which the electronic interface module further comprises a buffered crank signal output for coupling to the engine controller.

10. The engine cover of claim 5, wherein the electronic interface module is mounted into a recess in the engine cover and is operably coupled to the cam phaser position sensor and the cam phaser actuator by an interconnect harness.

11. The engine cover of claim 10 wherein the interconnect harness is molded to follow a contour of the engine cover.

12. The engine cover of claim 10 wherein the interconnect harness is mounted inside the engine cover.

13. The engine cover of claim 1, further comprising an active noise reduction system mounted upon the cover and coupled to the variable cam timing control.

* * * * *

UNITED STATES PATENT AND TRADEMARK OFFICE

CERTIFICATE OF CORRECTION

PATENT NO. : 6,435,154 B1
APPLICATION NO. : 09/886736
DATED : August 20, 2002
INVENTOR(S) : Roger T. Simpson and Danny R. Taylor It is certified that error appears in the above-identified patent and that said Letters Patent is hereby corrected as shown below:

Column 4, line 7 Claim 1: Delete the word “camshaft” and add the word --crankshaft--.

Signed and Sealed this

Fifteenth Day of April, 2008

JON W. DUDAS
*Director of the United States Patent and Trademark Office*